US006443856B1

(12) United States Patent
Galloway et al.

(10) Patent No.: US 6,443,856 B1
(45) Date of Patent: Sep. 3, 2002

(54) CONTOURED SCORELINES FOR THE FACE OF A GOLF CLUB

(75) Inventors: J. Andrew Galloway, Escondido; Richard C. Helmstetter, Rancho Santa Fe; Alan Hocknell, Carlsbad, all of CA (US)

(73) Assignee: Callaway Golf Company, Carlsbad, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/431,518

(22) Filed: Nov. 1, 1999

(51) Int. Cl.[7] ..... A63B 53/04; A63B 53/06; A63B 53/08

(52) U.S. Cl. ..... 473/330; 473/331; 473/345; 473/349

(58) Field of Search ..... 473/330, 331, 473/345

(56) References Cited

U.S. PATENT DOCUMENTS

| | | | | |
|---|---|---|---|---|
| 4,858,929 A | * | 8/1989 | Long | 273/77 A |
| 4,977,680 A | | 12/1990 | Marshall | |
| 4,993,710 A | | 2/1991 | Marshall | |
| 5,100,144 A | * | 3/1992 | Okumoto et al. | 273/167 |
| 5,163,682 A | * | 11/1992 | Schmidt et al. | 273/167 J |
| 5,643,099 A | | 7/1997 | Solheim | |
| 5,676,605 A | * | 10/1997 | Kobayashi | 473/331 |
| 5,888,148 A | * | 3/1999 | Allen | 473/290 |
| 5,967,904 A | * | 10/1999 | Nagai et al. | 473/345 |

FOREIGN PATENT DOCUMENTS

| | | |
|---|---|---|
| JP | 3280975 | 12/1991 |
| JP | 9253247 | 6/1997 |
| JP | 9308714 | 12/1997 |
| JP | 10179824 | 7/1998 |
| JP | 10179825 | 7/1998 |
| JP | 10225539 | 8/1998 |
| JP | 11-104280 | 4/1999 |
| JP | 11178956 | 7/1999 |
| JP | 10248974 | 9/1999 |

* cited by examiner

*Primary Examiner*—Paul T. Sewell
*Assistant Examiner*—Sneh Varma
(74) *Attorney, Agent, or Firm*—Michael A. Catania

(57) ABSTRACT

A golf club head having a face with a plurality of shorelines that have a contour with a continuous curvature is disclosed herein. The face has a thickness that is less than 0.110 inches, and each of the scorelines have a depth that is greater than 0.012 inches. The width of each of the scorelines may be between 0.028 inches and 0.032 inches. Each of the scorelines may have a contour with a first convex section, a concave section and a second convex section. Preferably, the face is composed of a forged titanium material. However, the face and/or club head body may be composed of steel, other metals and composite materials.

8 Claims, 4 Drawing Sheets

CONTOURED SCORELINES FOR THE FACE OF A GOLF CLUB

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to scorelines for a face of a golf club. More specifically, the present invention relates to stress reducing scorelines for a golf club.

2. Description of the Related Art

Scorelines have appeared on the faces of golf club heads since at least the 1880s if not earlier. Scorelines usually have a cross-section that is square or slightly curved on the walls perpendicular to the face.

However, scorelines act as a stress concentrator during impact of the club face with the golf ball. For the most part, this has been of little concern since the thickness of the face has been great enough to absorb the stress concentration caused by the scorelines. However, with the advent of hollow metal woods, stress has become of concern in the face of the club head. As the thickness of club heads become thinner, the need to relieve some of the stress concentration caused by scorelines will present a problem for the golf club industry.

The Rules of Golf, established and interpreted by the United States Golf Association ("USGA") and The Royal and Ancient Golf Club of Saint Andrews, set forth certain requirements for scorelines. The requirements for scorelines (grooves) are found in Rule 4 and Appendix II. A complete description of the Rules of Golf are available on the USGA web page at www.usga.org. Rule 4-1e of the Rules of Golf state specific guidelines for scorelines. The impact area of a club face may have a series of grooves with diverging sides and may have a symmetrical cross-section. The width and cross-section must be consistent across the face and along the length of the grooves. Any rounding of the groove edges shall be in the form of a radius which does not exceed 0.020 inches, and the width of the grooves shall not exceed 0.035 inches using the 30 degree method of measurement on file with the USGA. The distance between edges of adjacent grooves must not be less than three times the width of a groove, and not less than 0.0075 inches. The depth of a groove must not exceed 0.020 inches. Punch marks may be used if the area of such punch mark does not exceed 0.0044 square inches. A punch mark must not be closer to an adjacent punch mark than 0.168 inches measured from center to center. The depth of a punch mark must not exceed 0.040 inches. If punch marks are used in combination with grooves, a punch mark must not be closer to a groove than 0.168 inches measured from center to center.

BRIEF SUMMARY OF THE INVENTION

One aspect of the present invention is a golf club head including a face having a plurality of line scorelines. Each of the plurality of line scorelines has a contour with a continuous curvature. The face has a thickness that is less than 0.110 inches.

The contour of each of the plurality of line scorelines may have a first convex section, a concave section, and a second convex section. The greatest depth of each of the plurality of line scorelines may be less than 0.008 inches. The face may include a heel portion, a toe portion and a center portion juxtaposed by the heel portion and the toe portion, wherein the center portion is divided into a crown half and a sole half, and the crown half has an absence of line scorelines. The heel portion and the toe portion of the face may have an equal number of line scorelines. The vertical distance between each of the plurality of line scorelines may be equal. The width of each of the plurality of scorelines may be between 0.028 and 0.032 inches. The face may have a thickness in the range of 0.064 to 0.110 inches. The golf club head may be a metal wood and may be composed of a material selected from the group consisting of a forged titanium alloy material, steel, composite materials, and mixtures thereof. Alternatively, the golf club head may be an iron or a putter with a relatively thin face having the plurality of line scorelines thereon.

Another aspect of the present invention is a golf club head including a face having a plurality of line scorelines. Each of the plurality of line scorelines has a depth less than 0.012 inches and a contour including a first convex section, a concave section and a second convex section, with the face having a thickness that is less than 0.110 inches.

Yet another aspect of the present invention is a golf club head including a face having a plurality of line scorelines. Each of the plurality of line scorelines has a contour including a first convex section, a concave section and a second convex section, with each of the plurality of line scorelines having a depth that is greater than twenty percent of the thickness of the face. Thus, the depth of each of the line scorelines is substantial compared to the thickness of the face.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
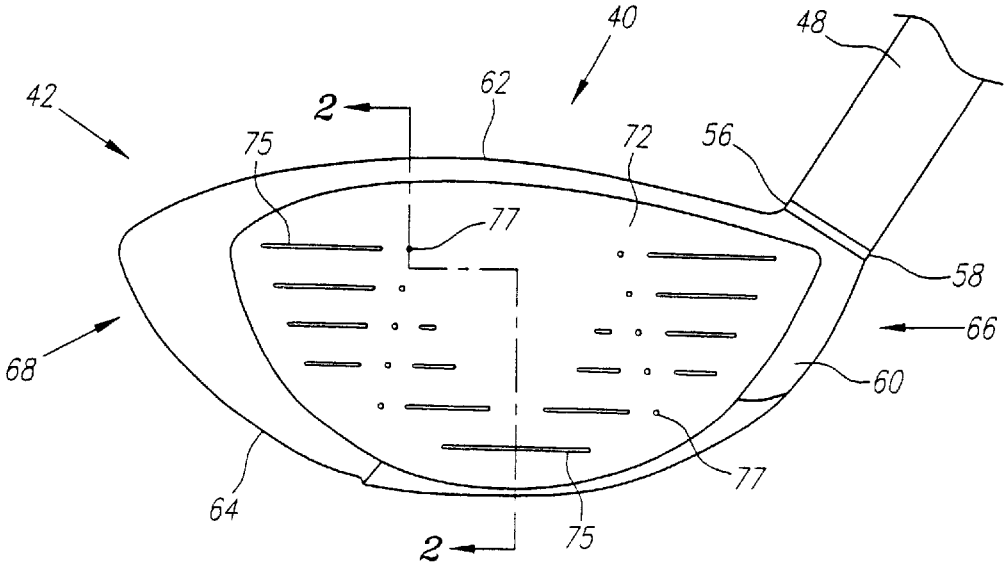
FIG. 1 is a front plan view of the golf club head of the present invention.
Figure 1A:
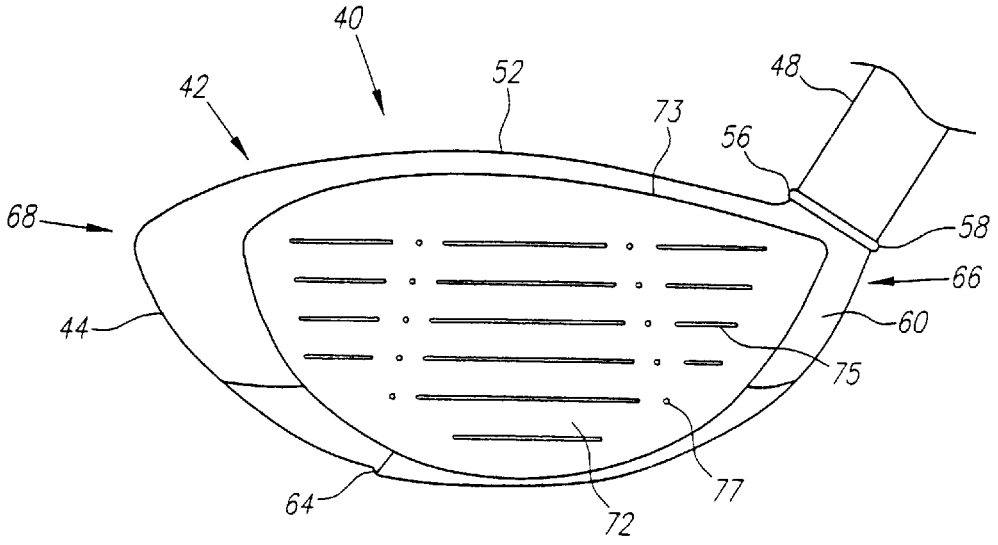
FIG. 1A is a front plan view of an alternative embodiment of the golf club head of the present invention.
Figure 1B:
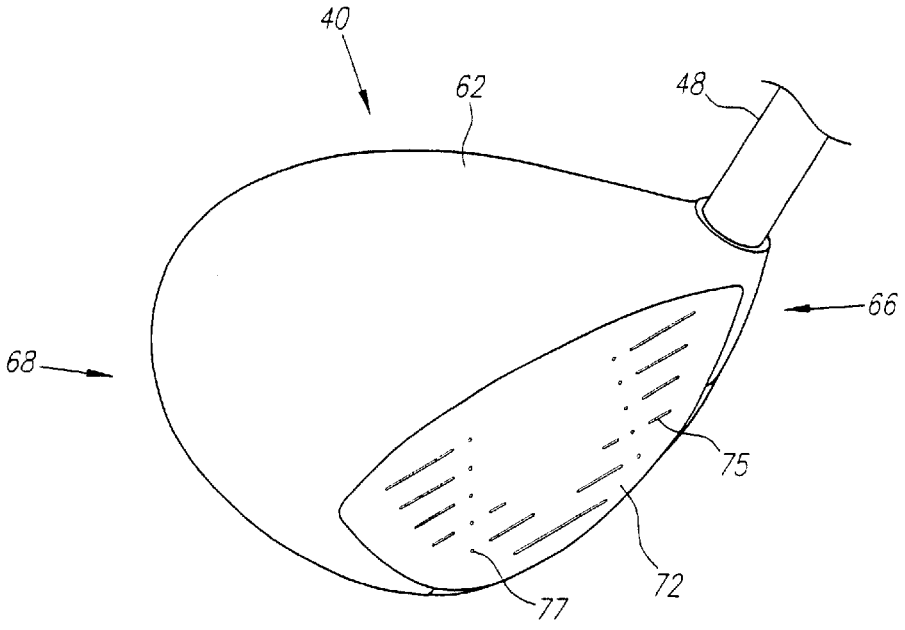
FIG. 1B is a perspective view of an further alternative embodiment of the golf club head of the present invention.

As shown in FIGS. 1, 1A and 1B, a golf club is generally designated 40. The golf club 40 has a golf club head 42 with a body 44 and a hollow interior, not shown. Engaging the club head 42 is a shaft 48 that has a grip 50, not shown, at a butt end and is inserted into a hosel 54 at a tip end. An O-ring 58 may encircle the shaft 48 at an aperture 59 to the hosel 54.

The body 44 of the club head 42 is generally composed of three sections, a face member 60, a crown 62 and a sole 64. The club head 42 may also be partitioned into a heel section 66 nearest the shaft 48, a toe section 68 opposite the heel section 66, and a rear section 70 opposite the face member 60.

The face member 60 is generally composed of a single piece of metal, and is preferably composed of a forged metal material. More preferably, the forged metal material is a forged titanium material. However, those skilled in the relevant art will recognize that other materials such as composite materials, alloys, steels and the like may be utilized without departing from the scope and spirit of the present invention. The face member 60 generally includes a face plate 72 and a face extension 74 extending laterally inward from the perimeter of the face plate 72. The face plate 72 has a plurality of line scorelines 75 thereon, and a plurality of dot scorelines 77. An alternative embodiment of the face plate 72 is illustrated in FIG. 1A which has a different scoreline pattern. The face extension 74 generally includes an upper lateral extension 76 and a lower lateral extension 78. A more detailed explanation of the face member 60 is set forth in co-pending U.S. patent application Ser. No. 09/431,982 filed on an even date herewith, entitled A Golf Club Head With A Face Composed Of A Forged Material, and now U.S. Pat. No. 6,354,962 and incorporated by reference in its entirety.

Figure 2:
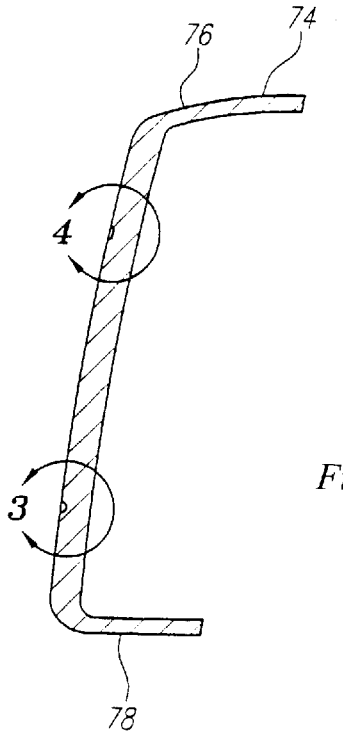
FIG. 2 is a cross-section view of FIG. 1 along lie 2—2.
Figure 3:
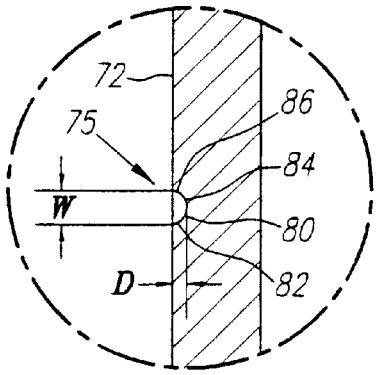
FIG. 3 is an enlarged view of circle 3 of FIG. 2 to illustrate the cross-section of a line to scoreline of the golf club head of the present invention.

FIG. 2 is a cross-sectional view of the face plate 72 of the present invention. Circles 3 and 4 correspond to one of the line scorelines 75 and one of the dot scorelines 77, respectively. As shown in FIG. 3, each of the line scorelines 75 has a contour 80 with a first convex portion 82, a concave portion 84 and a second convex portion 86. In a preferred embodiment, the radius of the concave portion 84 is 0.0156 inches. In a preferred embodiment, the radius of each of the first and second convex portions 82 and 86 is 0.002 inches. The depth "D" of each of the plurality of line scorelines 75 preferably ranges from 0.008 inches to 0.012 inches, and is most preferably 0.010 inches. The width "W" of each of the plurality of line scorelines 75 is preferably 0.030 inches.

Figure 4:
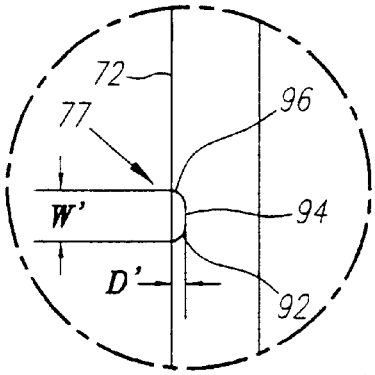
FIG. 4 is an enlarged view of circle 4 of FIG. 2 to illustrate the cross-section of a dot scoreline of the golf club head of the present invention.

As shown in FIG. 4, each of the dot scorelines 77 has a contour 90 with a first convex portion 92, a straight portion 94 and a second convex portion 96. In a preferred embodiment, the radius of each of the first and second convex portions 92 and 96 is 0.004 inches. The depth "D" of each of the plurality of dot scorelines 77 preferably ranges from 0.006 inches to 0.008 inches, and is most preferably 0.007 inches. The width "W" of each of the plurality of dot scorelines 77 is preferably 0.029 inches.

Figure 7:
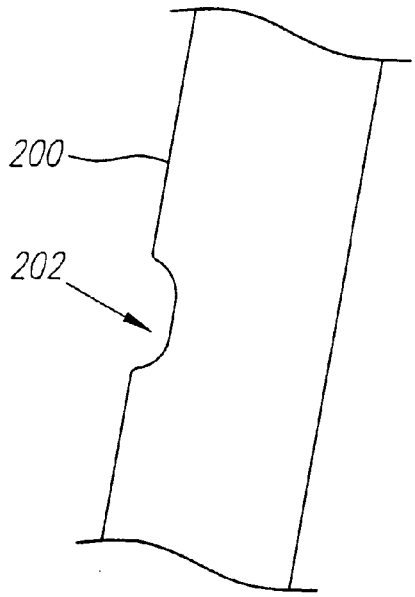
FIG. 7 is a cross-sectional view of a scoreline of the prior art.

The contoured scorelines 75 assist in relieving stress on the face plate 72 since scorelines in general have the effect of concentrating stress during impact with a golf ball. As shown in FIG. 7, the prior art scorelines 202 on a face 200 have relied on the thickness of the face to use a squarer cross-section for the scorelines 200. In face plates 72 that are relatively thin, the concentration of stress could lead to failure of the face plate 72. In one embodiment of the present invention, the face plate thickness ranges from 0.06 inches to 0.103 inches. In this thickness range, the contour 80 of each of the plurality of line scorelines 75 assist in reducing the concentration of stress in the face plate 72 during impact with a golf ball.

Figure 5:
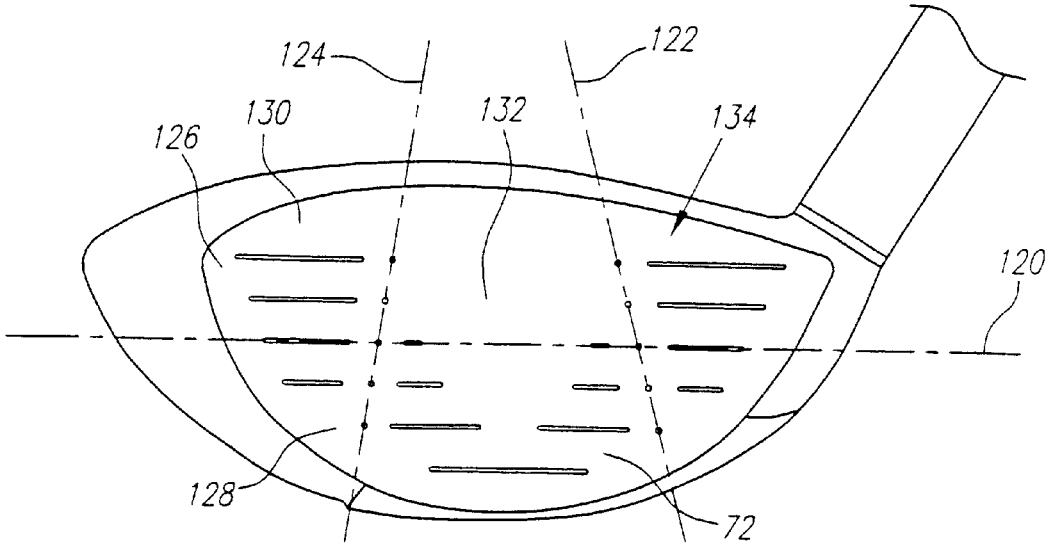
FIG. 5 is a front plan view of the preferred embodiment of the present invention, as illustrated in FIG. 1, illustrating the partitioning of the face plate of the golf club head of the present invention.

Additionally, mapping of the face plate 72 for the probable impact locations to determine the highest stress areas resulted in the absence of scorelines in the preferred embodiment of the present invention, as shown in FIG. 5. The face plate 72 is divided into a crown half 126 and a sole half 128 by a horizontal line 120. The face plate 72 is further partitioned into a toe portion 130, a center portion 132 and a heel portion 134 by two vertically angled lines 122 and 124 which lie on the two angled columns of dot scorelines 77. Thus, center portion 132 of the crown half 126 has an absence of scorelines since this area has the highest probability of impacts with a golf ball.

Figure 6:
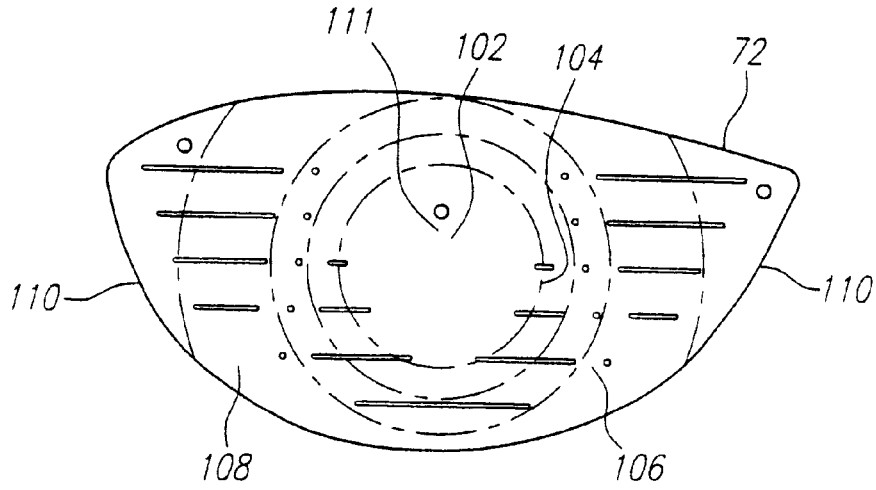
FIG. 6 is an isolated view of the face plate the golf club head of the present invention illustrating the regions of thickness of the face plate.

FIG. 6 illustrates the variation in the thickness of the face plate 72 for one embodiment of the present invention. The face plate 72 is partitioned into elliptical regions, each having a different thickness. A central elliptical region 102 preferably has the greatest thickness that ranges from 0.110 inches to 0.091 inches, preferably from 0.099 inches to 0.093 inches, and is most preferably 0.095 inches. A first concentric region 104 preferably has the next greatest thickness that ranges from 0.097 inches to 0.082 inches, preferably from 0.090 inches to 0.082 inches, and is most preferably 0.086 inches. A second concentric region 106 preferably has the next greatest thickness that ranges from 0.094 inches to 0.070 inches, preferably from 0.078 inches to 0.070 inches, and is most preferably 0.074 inches. A third concentric region 108 preferably has the next greatest thickness that ranges from 0.090 inches to 0.07 inches. A periphery region 110 preferably has the next greatest thickness that ranges from 0.069 inches to 0.061 inches. The variation in the thickness of the face plate 72 allows for the greatest thickness to be distributed in the center 111 of the face plate 72 thereby enhancing the compliance of the face plate 72 during impact with a golf ball.

Additionally, the face plate 72 of the present invention has a smaller aspect ratio than face plates of the prior art. The aspect ratio as used herein is defined as the width, "w", of the face divided by the height, "h", of the face, as shown in FIG. 1A. In conventional golf club heads, the aspect ratio is usually much greater than 1. For example, the original GREAT BIG BERTHA® driver from Callaway Golf Company had an aspect ratio of 1.9. The face of the present invention has an aspect ratio that is no greater than 1.7. The aspect ratio of the present invention preferably ranges from 1.0 to 1.7, and is most preferably 1.3. The face of the present invention is more circular than faces of the prior art. The face area of the face plate 72 of the present invention ranges from 4.95 square inches to 5.1 square inches.

The aspect ratio, area and thickness of the face plate 72 of the preferred embodiment of the present invention all increase the concentration of stress in the line scorelines 75. The contour 80 of each of the plurality of line scorelines 75 relieves some of this stress providing the face plate 72 with greater durability. A more detailed explanation of the aspect ratio, area and thickness of the face plate 72 of the preferred embodiment of present invention is set forth in the previously mentioned co-pending U.S. patent application Ser. No. 09/431,982, filed on an even date herewith, entitled A Golf Club Head With A Face Composed Of A Forged Material, and now U.S. Pat. No. 6,354,962.

Although the present invention has been described in reference to a wood golf club head, those skilled in the relevant art will readily recognize that the scorelines of the present invention may be utilized with an iron or putter golf club head without departing from the scope or spirit of the present invention.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A wood-type golf club head comprising:

a body having a hollow interior and being comprised of a sole, a crown and a face member comprising a face plate and a face extension, the body composed of a forged titanium material and having a volume in the range of 300 cubic centimeters to 310 cubic centimeters, a weight in the range of 188 grams to 195 grams, and a face area of the face plate ranging from 4.95 square inches to 5.1 square inches and the face plate having a thickness that is less than 0.110 inch;

a plurality of line scorelines located on the face, each of the plurality of line scorelines having a contour with a continuous curvature, and each of the plurality of line scorelines comprising a first convex section, a concave section, and a second convex section; and wherein the greatest depth of the plurality of each of the plurality of line scorelines is less than 0.012 inch wherein the face plate is devoid of scorelines in the center section of the crown half, wherein the wood-type golf club head has a coefficient of restitution of at least 0.83.

2. The golf club head according to claim 1 wherein the heel portion and the toe portion of the face have an equal number of line scorelines.

3. The golf club head according to claim 1 wherein the vertical distance between each of the plurality of line scorelines is equal.

4. The golf head according to claim 3 wherein the width of each of the plurality of scorelines is between 0.028 and 0.032 inches.

5. The golf cub head according to claim 1 wherein the face has a thickness in the range of in the range of 0.064 to 0.110 inches.

6. A wood-type golf club head comprising:

a body having a hollow interior and being comprised of a sole, a crown and a face member having a face plate and a face extension extending laterally inward from the perimeter of the face plate, the face plate having a thickness ranging from 0.103 inch to 0.06 inch, the face plate having a plurality of line scorelines, and a plurality of dot scorelines each of the plurality of line scorelines having a contour comprising a first convex section, a concave section, and a second convex section and each of the dot scorelines having a contour with a first convex portion, a straight portion, and a second convex portion;

where the plurality of line scorelines has a radius of the first convex portion and the second convex portion of 0.002 inch and a radius of the concave portion of 0.0156 inches a depth of each of the line scorelines ranging from 0.008 inch to 0.012 inch and a width of each of the line scorelines of 0.030 inch; and wherein the plurality of the dot scorelines has a radius of the first convex portion and the second convex portion of 0.004 inch, and a depth of the first convex portion and second convex portion ranging from 0.006 inch to 0.008 inch and a width of the first convex portion and the second convex portion of 0.029 inch; and wherein the plurality of dot scorelines form two vertically angled lines such that the face plate is further divided into a toe portion, a heel portion, and a center portion and such that there is an absence of scorelines in the center portion of the crown half, and wherein the wood-type golf club head has a coefficient of restitution of at least 0.83.

7. The golf club head according to claim 6, wherein the length of each of the plurality of scorelines is between 0.5 and 1.0 inch.

8. A golf club head comprising:

a body having a hollow interior and being comprised of a sole, a crown and a face member having a face plate and a face extension the body composed of a forged titanium material and having a volume in the range of 300 cubic centimeters to 310 cubic centimeters, a weight in the range of 188 grams to 195 grams, and a face area of the face plate ranging from 4.95 square inches to 5.1 square inches and having a thickness that is less than 0.0110 inch;

the face plate being divided into a heel portion, a toe portion and a center portion juxtaposed by the heel section and the toe section, and having a plurality of line scorelines located in the toe section and heel section, each of the plurality of line scorelines having a contour comprising a first convex section, a concave section and a second convex section, wherein each of the plurality of line scorelines have a depth that is greater than twenty percent of the thickness of the face, wherein the face plate has a central elliptical region with an uniform thickness ranging from 0.110 inch to 0.091 inch, a first concentric region with an uniform thickness ranging from 0.090 inch to 0.082 inch, and a second concentric region with an uniform thickness ranging from 0.078 inch to 0.070 inch, and wherein the wood-type golf club head has a coefficient of restitution of at least 0.83.

* * * * *